US010016051B2

(12) United States Patent
Hintze

(10) Patent No.: US 10,016,051 B2
(45) Date of Patent: Jul. 10, 2018

(54) TOOL RETAINING APPARATUS

(71) Applicant: Ian Hintze, Lynbrook, NY (US)

(72) Inventor: Ian Hintze, Lynbrook, NY (US)

( * ) Notice: Subject to any disclaimer, the term of this patent is extended or adjusted under 35 U.S.C. 154(b) by 0 days.

(21) Appl. No.: 15/263,060

(22) Filed: Sep. 12, 2016

(65) Prior Publication Data

US 2017/0065066 A1 Mar. 9, 2017

Related U.S. Application Data

(63) Continuation of application No. 14/322,569, filed on Jul. 2, 2014, which is a continuation-in-part of application No. 29/460,265, filed on Jul. 9, 2013, now Pat. No. Des. 720,529.

(51) Int. Cl.

| | |
|---|---|
| ***A45F 5/00*** | (2006.01) |
| ***A45F 5/02*** | (2006.01) |
| ***B25H 3/00*** | (2006.01) |

(52) U.S. Cl.

CPC ..... *A45F 5/021* (2013.01); *B25H 3/00* (2013.01); *A45F 2005/008* (2013.01); *A45F 2200/0575* (2013.01)

(58) Field of Classification Search

CPC .... A45F 2200/0575; A45F 5/021; A45F 5/00; A45F 2003/144; A45F 2005/008

USPC ..... 224/661, 222, 223, 904

See application file for complete search history.

(56) References Cited

U.S. PATENT DOCUMENTS

| | | | | |
|---|---|---|---|---|
| 1,990,135 | A | 2/1935 | Sato | |
| 2,400,417 | A | 5/1946 | Hickey | |
| 2,542,580 | A | 2/1951 | Sato | |
| 2,683,000 | A | 7/1954 | Beiderwell | |
| 3,420,503 | A | 1/1969 | Stangl | |
| 3,907,182 | A * | 9/1975 | Bryant | F16B 2/185 224/670 |
| 4,303,187 | A | 12/1981 | Berman | |
| 4,826,059 | A * | 5/1989 | Bosch | A45C 11/24 206/350 |
| 4,848,624 | A * | 7/1989 | Clem | A45C 1/04 224/222 |
| 4,953,767 | A | 9/1990 | Bennett | |
| 4,993,614 | A | 2/1991 | Bonofiglo | |
| D348,778 | S | 7/1994 | Dancyger | |
| 5,337,933 | A * | 8/1994 | Nunez | A01K 97/06 224/581 |
| 5,445,303 | A * | 8/1995 | Cawile, Jr. | F41C 33/00 224/222 |

(Continued)

OTHER PUBLICATIONS

"Blackhawk Omega VI Ultra Holster" http://www.copsplus.com/prodnum7220.php—undated.

(Continued)

*Primary Examiner* — Adam Waggenspack

(74) *Attorney, Agent, or Firm* — Hoffmann & Baron, LLP

(57) ABSTRACT

A retaining apparatus includes a body having retainers for securing a plurality of tools thereto. A first and second hanger each has a first and second end. The hanger first ends each include an attachment member securable to a wearer. The hanger second ends each are secured to the body. The first hanger is spaced from the second hanger along a longitudinal extent of the body. A leg strap is secured to the body, and the leg strap includes a fastening device to allow the leg strap to be opened and closed and secured around the thigh of a wearer.

13 Claims, 8 Drawing Sheets

(56) References Cited

U.S. PATENT DOCUMENTS

| | | | | |
|---|---|---|---|---|
| D366,144 | S | 1/1996 | Alves | |
| 5,517,696 | A * | 5/1996 | Krugler | A41D 27/20 2/247 |
| 5,568,889 | A | 10/1996 | Holloway, Jr. et al. | |
| D417,073 | S | 11/1999 | Diener | |
| D433,229 | S | 11/2000 | Harker | |
| 6,149,042 | A | 11/2000 | Rassias | |
| D436,243 | S | 1/2001 | Hoy | |
| D436,436 | S | 1/2001 | Lin | |
| D447,864 | S | 9/2001 | Casparian | |
| 6,587,022 | B1 * | 7/2003 | Devine | A45F 5/00 206/350 |
| D496,157 | S * | 9/2004 | Contarino, Jr. | D3/228 |
| 6,820,838 | B2 | 11/2004 | Martin et al. | |
| 6,863,202 | B2 * | 3/2005 | Ammerman | A45C 13/30 150/110 |
| D507,106 | S | 7/2005 | Lyle | |
| 7,188,713 | B1 | 3/2007 | Espar et al. | |
| 7,766,203 | B2 | 8/2010 | Marinaj | |
| 2003/0213827 | A1 | 11/2003 | Langmuir | |
| 2005/0120454 | A1 | 6/2005 | Cunningham | |
| 2005/0263550 | A1 * | 12/2005 | Williams | A45F 5/00 224/221 |
| 2005/0263553 | A1 | 12/2005 | Williams | |
| 2008/0083796 | A1 | 4/2008 | Lalli | |
| 2008/0185412 | A1 | 8/2008 | Hollins | |
| 2009/0302082 | A1 | 12/2009 | Freeny | |
| 2010/0294821 | A1 | 11/2010 | Szabo | |
| 2012/0152992 | A1 * | 6/2012 | Baas | B60R 7/005 224/275 |

OTHER PUBLICATIONS

"Cqc Drop Leg Mag Flashlight Pouch for P226 Airsoft Pistol Hoster" http://www.alibaba.com/product-gs/868859861/CQC_Drop_Leg_Mag_Flashlight_Pouch.html—undated.

"Tactical Drop Leg Rig w/ Universal Belt" http://www.majorsurplus.com/tactical-drop-leg-rig-w-universal-belt-p13878.aspx—undated.

"Pro-Fit Carry Systems" http://www.pro-fitcarrysystems.com/modular-leg-plafform.html—undated.

Pro-Fit Carry Systems :: "Pro Fit Introduces Thigh Tool Carrier Belt" Wastewater Press Release—undated.

Design U.S. Appl. No. 29/449,889 to Ian Hintze filed Mar. 15, 2013.

U.S. Appl. No. 13/867,888 to Ian Hintze filed Apr. 22, 2013.

U.S. Appl. No. 29/460,265 to Ian Hintze filed Jul. 9, 2013.

U.S. Appl. No. 14/322,569 to Ian Hintze filed Jul. 2, 2014.

* cited by examiner

TOOL RETAINING APPARATUS

This application is a continuation of U.S. patent application Ser. No. 14/322,569 filed Jul. 2, 2014, which is a continuation in part of U.S. patent application Ser. No. 29/460,265 filed Jul. 9, 2013. The entire contents of each application is incorporated by reference herein in their entireties.

FIELD OF INVENTION

The present invention relates to an apparatus for securing a tool or accessory to a user. More particularly, the present invention relates to an apparatus for securing tools to a wearer supported by the leg and waist belt of the wearer.

BACKGROUND OF THE INVENTION

During construction, it is desirable for a worker to have the tools and accessories needed for a particular job in close reach or preferably secured to the worker. Typically, in such cases, a worker will wear a tool belt including one or more pouches for holding tools.

Tools such as hammers, pliers, wrenches, screwdrivers, and measuring tape reels can cause the tool pouch to protrude a good distance out from a wearer's waist belt. Because of the size of the tools, the tool pouch tends to dig into the side or ribs of the wearer and limits freedom of movement. In addition, the weight of the wools is borne by the waist, and this places stress on the wearer's side and back. Over time, the wearer can experience significant discomfort caused by the waist only secured tool belt.

Furthermore, during certain construction jobs, it is desirable, or required, to wear a safety harness in order to prevent falls. Such harnesses typically include straps which go around the waist and can interfere with the wearing of a traditional tool belt. In order to properly attach the safety harness to the wearer, the tool belt must be removed. Once the safety harness is secured, the tool belt can then be re-secured to the wearer. Removal of the safety harness also requires removal of the tool belt. This need to remove the tool belt decreases the efficiency of the wearer.

Accordingly, it is desirable to provide an apparatus for retaining tools on a wearer which allows for freedom of movement and permits other devices to be worn.

SUMMARY

The present disclosure provides a tool retaining apparatus including a body having retainers for securing a plurality of tools thereto. A first and second hanger each has a first and second end. The hanger first ends each include an attachment member securable to a wearer. The hanger second ends each are secured to the body. The first hanger is spaced from the second hanger along a longitudinal extent of the body. A leg strap is secured to the body, and the leg strap includes a fastening device to allow the leg strap to be opened and closed and secured around the thigh of a wearer.

The present disclosure further provides a tool retaining apparatus including a first hanger strap having a first and second end, the first end including an attachment member securable to a belt of a wearer; and tool pouch including a plurality of tool retainers for securing a plurality of tools, the first hanger strap being secured to, and extending from, the tool pouch. A leg strap is adapted to be removably secured around a leg of a wearer. The leg strap is secured to the tool pouch. The leg strap includes a fastening device to allow the leg strap to be opened and closed and secured around the leg of a wearer. The first hanger strap has a length such that the tool pouch is secured a distance D below the belt of the wearer.

The present disclosure still further provides a tool retaining apparatus including a tool carrier having a plurality of retainers for securing a plurality of tools thereto. The tool carrier has a first fold line formed thereon extending generally transverse to a longitudinal extent of the tool carrier. The fold line facilitates folding of the tool carrier about the fold line. A first and second hanger each has a first and second end. The hanger first ends each include an attachment member securable to a wearer. The hanger second ends each are secured to the body. The first hanger is spaced from the second hanger along a longitudinal extent of the body. A leg strap is secured to the body, and the leg strap includes a fastening device to allow the leg strap to be opened and closed and secured around the thigh of a wearer.

DETAILED DESCRIPTION

Figure 1:
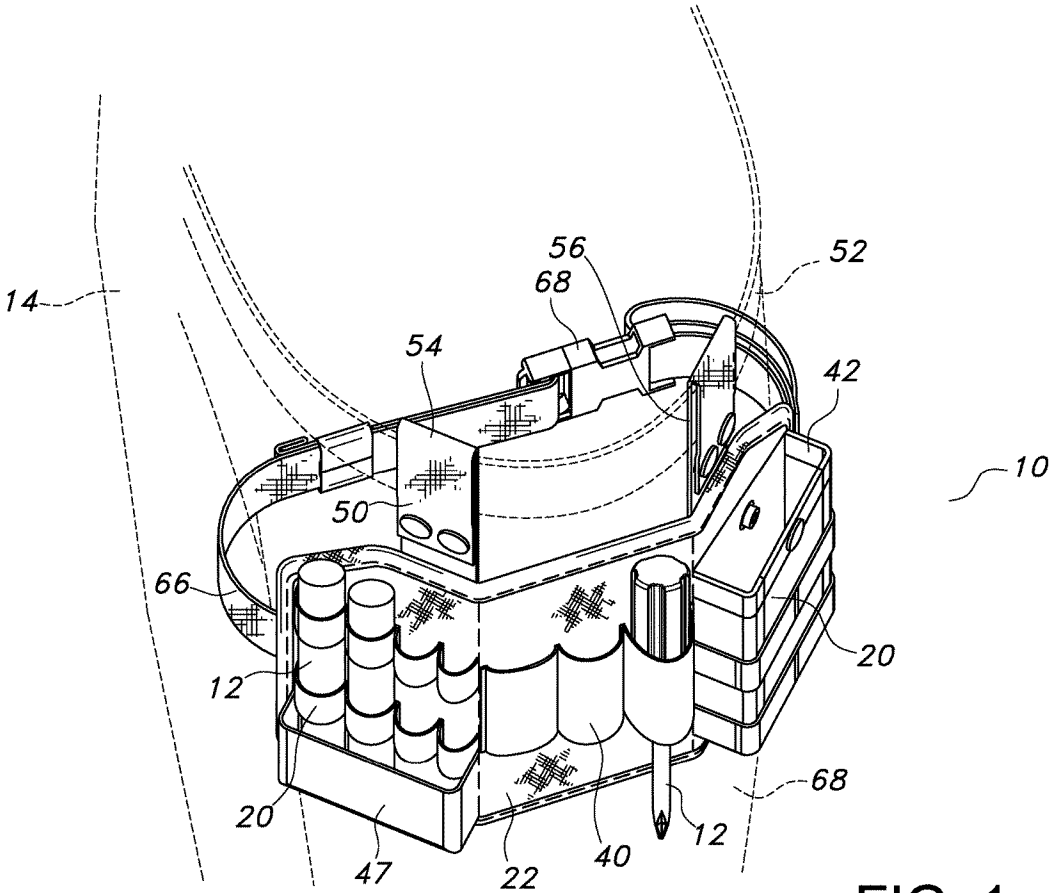
FIG. 1 is a front perspective view of the tool retaining apparatus secured to an individual with tools shown in phantom.
Figure 2:
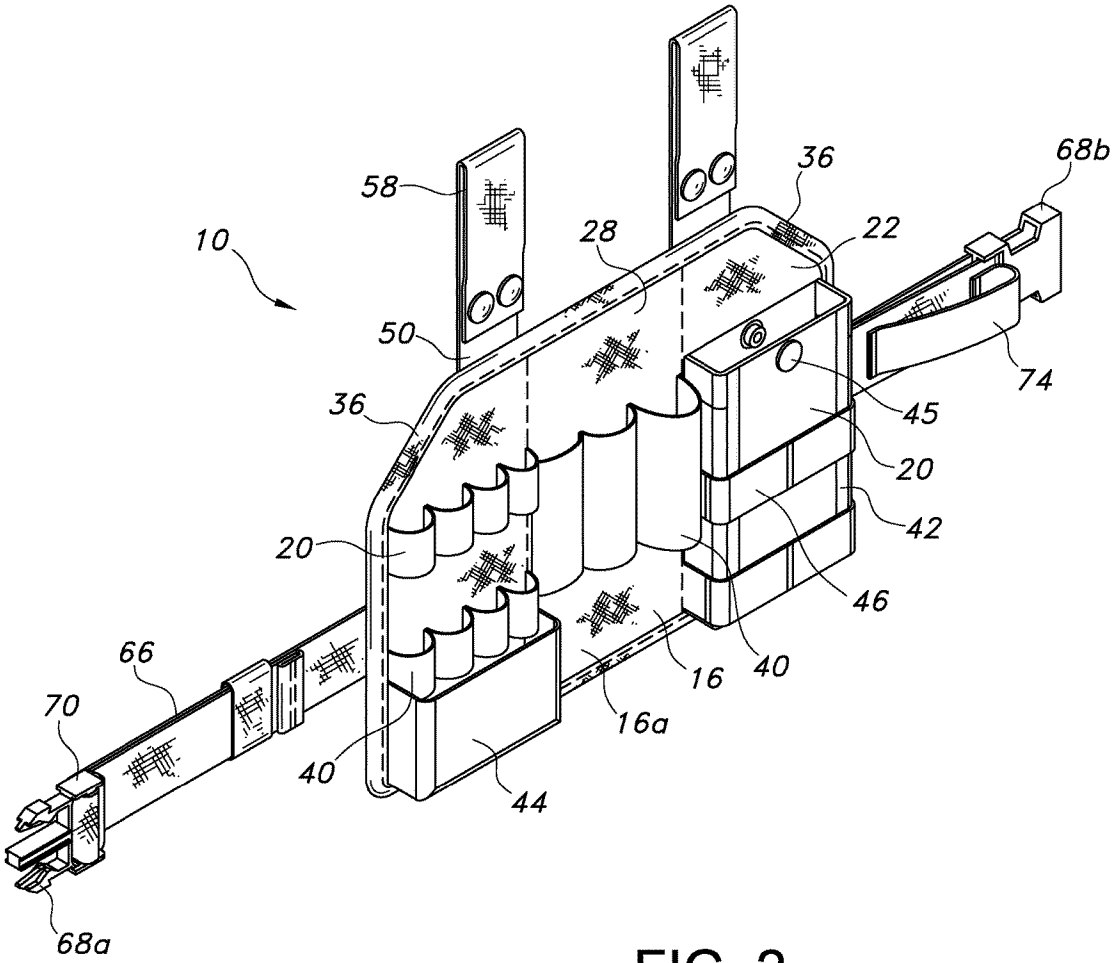
FIG. 2 is front perspective view of the tool retaining apparatus.
Figure 3:
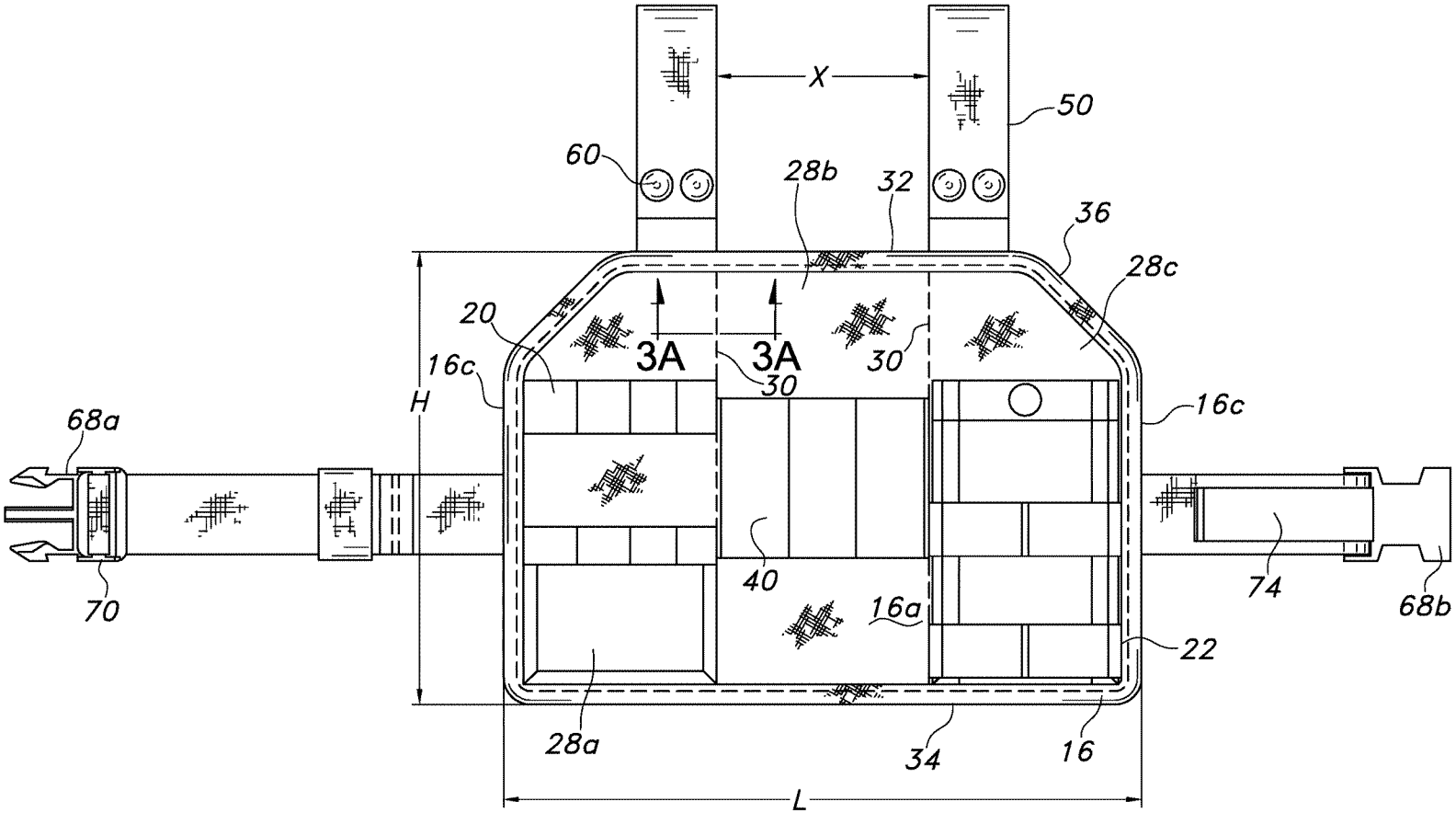
FIG. 3 is a front elevational view of the tool retaining apparatus.

With reference to FIGS. 1-3, the present invention provides a tool retaining apparatus 10 for securing tools or accessories 12 to a wearer 14 of the apparatus. The tools or accessories 12, referred to herein collectively as "tools", may be in the form of a screwdriver, pliers, hammer, punch, wrench, nail set, measuring tape, fasteners, and the like. The tool retaining apparatus 10 allows the tools 12 to be safely and comfortably and safely carried by the user around a job site while allowing the tools to be readily available for use.

Figure 5:
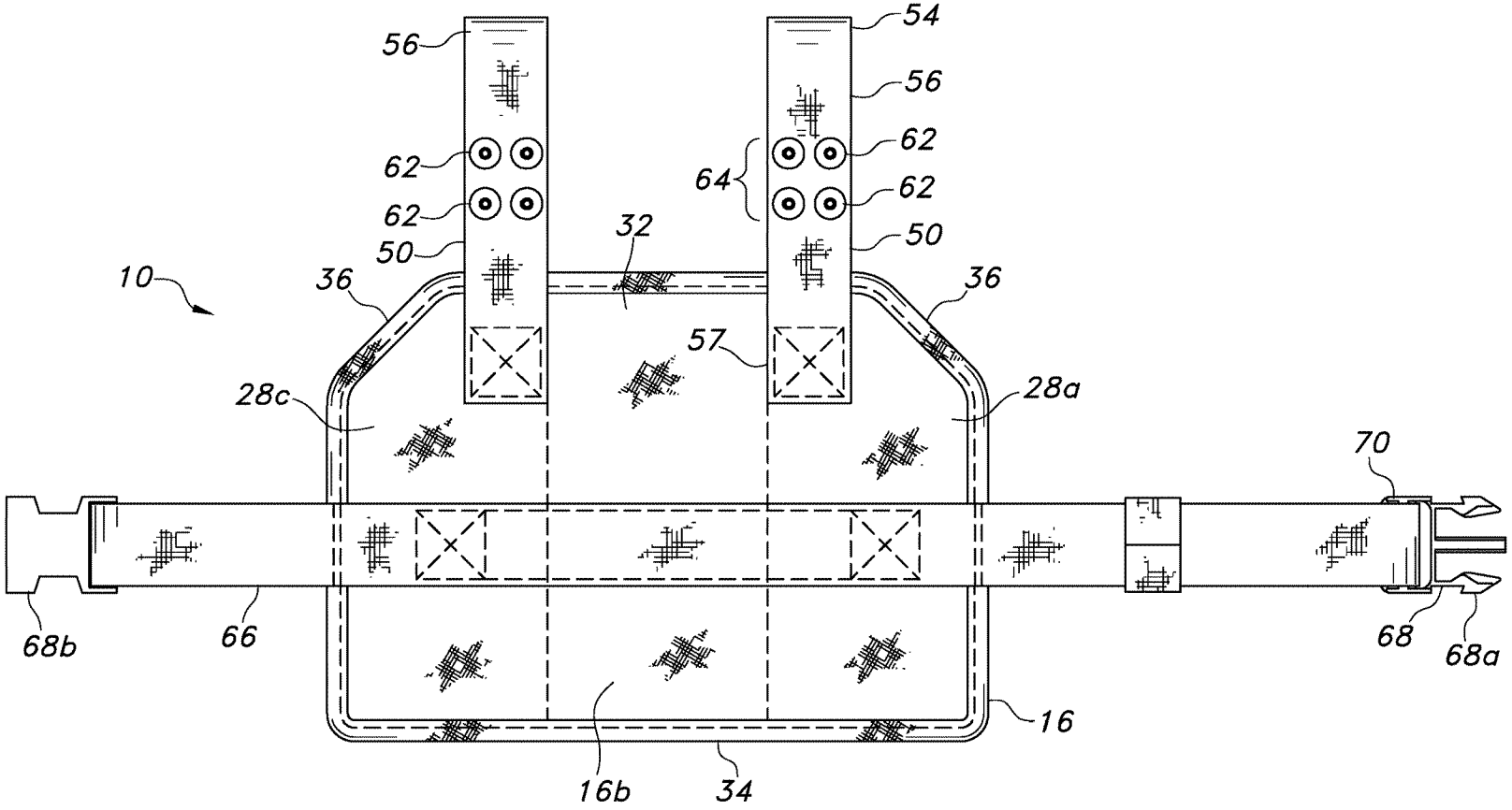
FIG. 5 is a back elevational view of the tool retaining apparatus.
Figure 7:
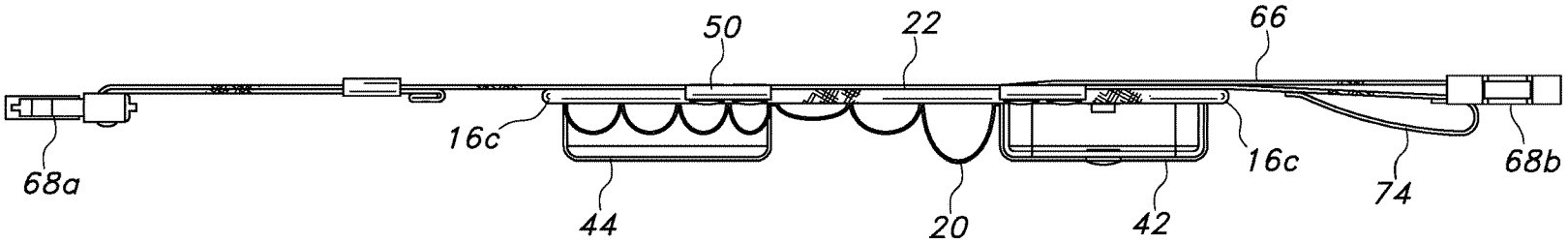
FIG. 7 is a top plan view of the tool retaining apparatus.
Figure 8:
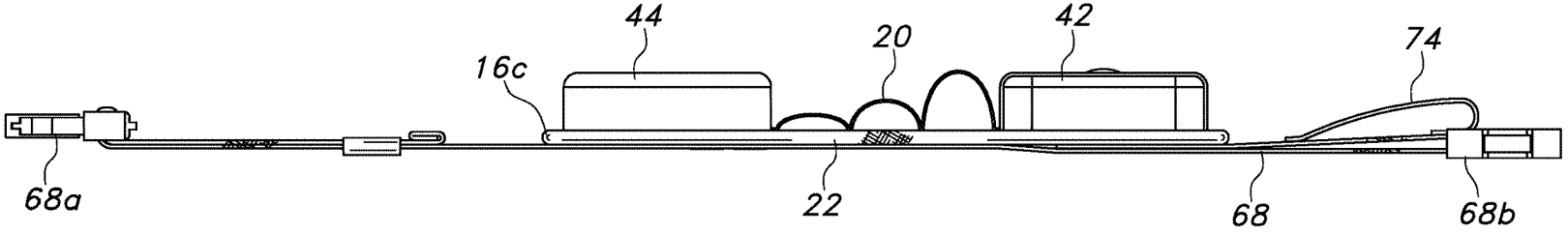
FIG. 8 is a bottom view of the tool retaining apparatus.

With additional reference to FIG. 5, the tool retaining apparatus 10 includes a body 16, and the body consists of a generally planar member having a front side 16*a* and a rear side 16*b*. The body 16 has a longitudinal extent L bounded by opposed side edges 16*c*. The front side 16*a* includes a plurality of tool retainers 20 for securing tools and/or accessories to the body. The body 16 and the tool retainers 20 together form a tool carrier 22 for holding the tools 12.

Figure 3A:
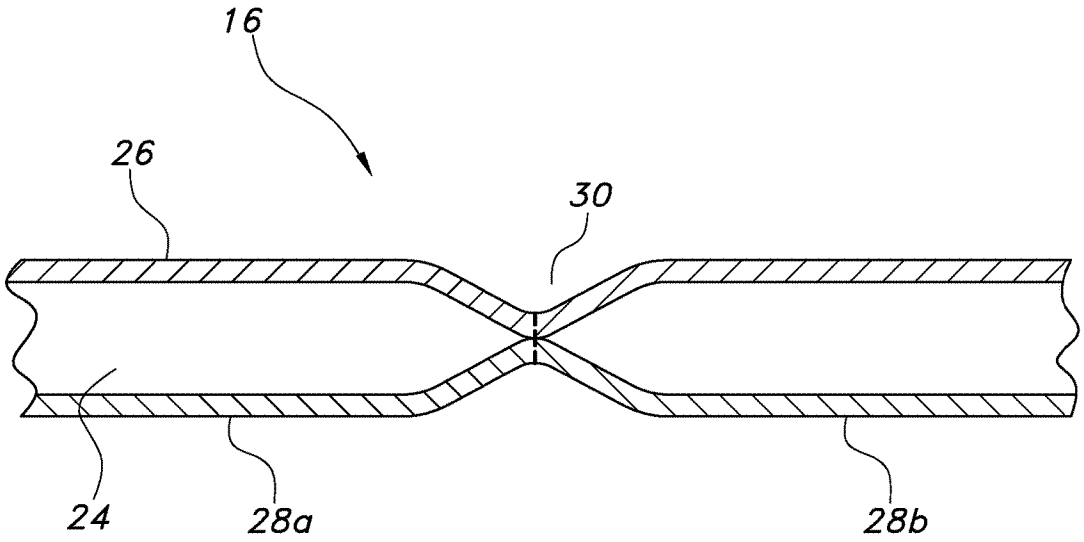
FIG. 3A is a cross-sectional view taken along line 3A-3A of FIG. 3.

With reference to FIGS. 3 and 3A, in one embodiment, the body 16 may include a core 24 formed of a resilient material encased in a wear resistant outer fabric material 26 such as ballistic nylon or Cordura®. The body 16 may be divided into a plurality of segments 28 by vertically extending fold lines 30 that extend between a top edge 32 and bottom edge 34 of the body. In the embodiment shown in FIGS. 1-3A, two fold lines 30 form three body segments 28*a*, 28*b*, and 28*c*. The fold lines 30 extend generally transverse to the longitudinal extent L of the body. At the fold lines 30, the core 24 may be interrupted or thinned in order to allow the body segments 28 to fold easily such that the body conforms to a wearer's leg 69 when the tool retaining apparatus 10 is secured to a user. The fold lines 30 may be formed by stitching extending between the front 16*a* and back 16*b* sides of the body.

The resilient core 24 may function as padding which helps to isolate the tools 12 from the wearer. Therefore, when the wearer brushes up against an object or surface, and the tools 12 are pressed towards the wearer, the resilient core 24 will help protect the wearer from being impacted by the tools 12.

The tool retaining apparatus body 16 may include a generally rectangular configuration with tapered upper corners 36. However, it is within the contemplation of the present invention that the body 16 may be formed in different shapes in order to accommodate different types of tools or different types of applications.

With reference to FIGS. 1-3, the tool retainers 20 may include a series of elastic loops 40 of different sizes secured in an undulating fashion to the body front surface 16*a*. In addition, first and second pockets 42 and 44, respectively, may be located on the body front surface 16*a* in order to retain tools 12. The first and second pockets may be formed in different sizes. In one embodiment, first pocket 42 may be larger than second pocket 44 and extend almost the entire height, H, of the body. The opening of the first pocket 42 may be closed by a fastener 45. Second pocket 44 may be located directly below a series of tool holding elastic loops 40 such that the end of the tools may rest within the second pocket 44. The first and second pockets 42 and 44 may be formed of the same material as the outer fabric material 26 which forms the body 16. In addition, non-elastic loops 46 formed of strapping material may be secured to the outer surface of first pocket 42 in order to provide an additional location to secure tools 12.

The body 16 may be secured to a wearer by hangers 50. Body 16 may have extending outwardly therefrom one or more hangers 50. While two hangers 50 are show herein, it is contemplated that one hanger or more than two hangers could be used. The hangers 50 extend in a generally vertical direction perpendicular to the longitudinal, L, extent of the body. The hangers 50 may be in the form of a strap formed of a nylon material or formed of leather or synthetic leather or other type of material known in the art for making straps or strap-like devices. With reference to FIGS. 1, 1A, and 4-6, the hangers 50 may be securable to a wearer, for example a wearer's waist belt 52, such that the tool retaining apparatus 10 hangs from the belt. However, it is also contemplated that the hangers 50 may be attachable to other elements of the wearer or their clothing. Each hanger 50 may be a pliable piece of material, such as a strap, including a first end 54 having a belt attachment device 56 and a second end 57 secured adjacent to the top edge 32 of the back side 16*b* of the body. One of the hangers 50 may be secured to body segment 28*a* and the other secured to segment 28*c*. Body segment 28*c* is disposed between segment 28*a* and 28*b*. Therefore, as shown in FIG. 1, the body 16 is free to bend and flex to follow the curve of the wearer's waist when the apparatus 10 is being worn. The hangers 50 may be spaced a distance X (FIG. 3) from each other so that the retainer 10 is comfortably carried by the waist belt. The distance X in one embodiment may be about 4 inches however, the distance X may be in the range of about 3 to 6 inches. It is further contemplated that other dimensions for distance X could be selected to accommodate tool carriers of different sizes.

Figure 6:
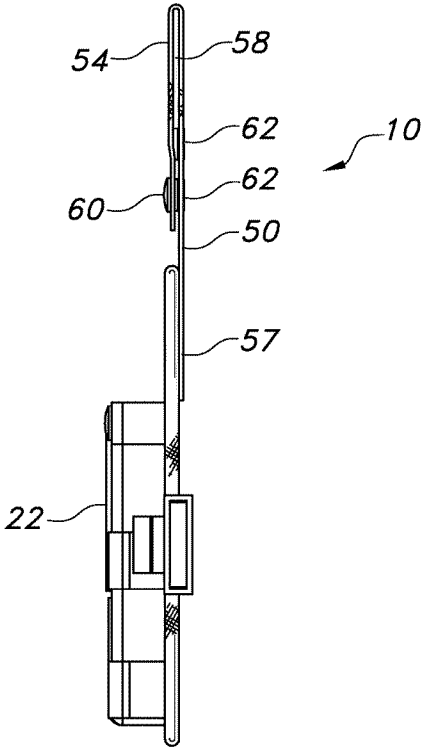
FIGS. 4 and 6 are side views of the tool retaining apparatus.
Figure 4:
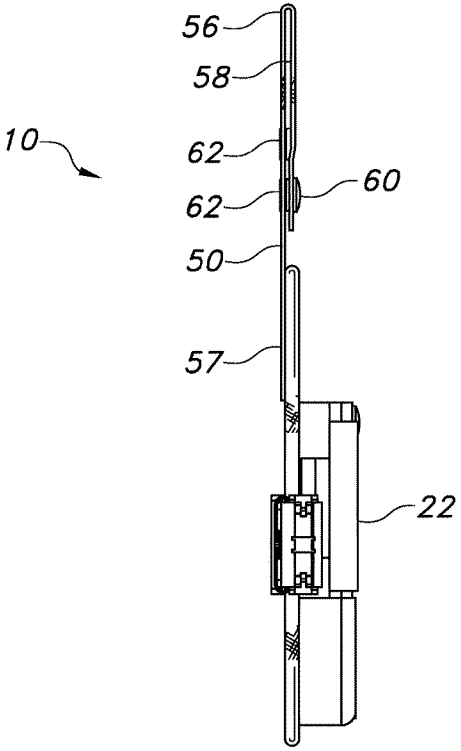

With reference to FIGS. 1, 4 and 6, the belt attachment device 56 may include a loop 58 into which a belt 52 is inserted. The loop 23 may be formed by overlapping the hanger material and stitching, or otherwise fixing the end to the hanger material. Alternatively, the attachment device 56 may be a clip or a buckled device which would allow the hanger 50 to be secured and removed from the belt 52 without the wearer having to remove their waist belt.

In a preferred embodiment, the loop 58 may be formed by the engagement of a fastener first part 60 disposed on a distal end of the hanger and a complimentary fastener second part 62 disposed on a medial portion of the hanger 60. The fastener parts 60 and 62 may be in the form of snaps, although it is within the contemplation of the present invention that other types of fasteners could be employed. In order to form the loop 58 the user may snap the fasteners parts 60 and 62 together.

Figure 1A:
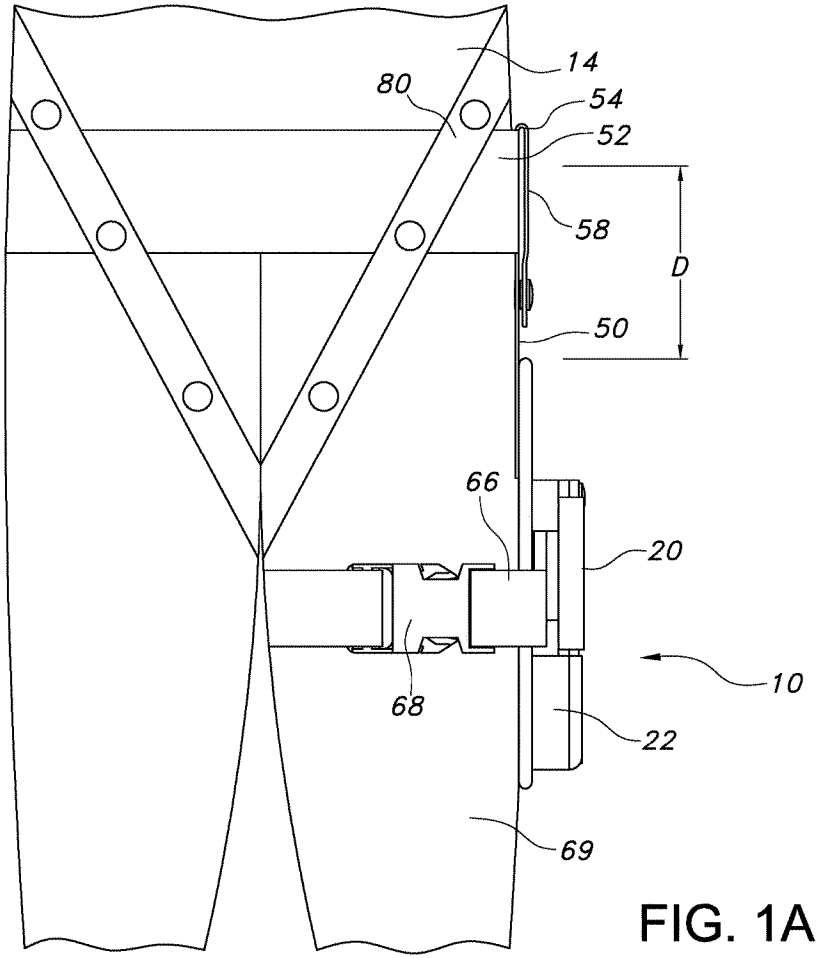
FIG. 1A is side elevational view of the tool retaining apparatus secured to an individual.

Due to the length of the hangers 50, the tool carrier 22 depends downwardly from the wearer's belt and waist a distance D (FIG. 1A). The distance D is from the belt line, or waist, of a wearer to the top the tool carrier. The belt hangers 50 may be formed as a fixed length or may have an adjustment device 64 such that the length of the hangers 50 may be lengthened and shortened. With an adjustment device, the tool carrier 22 can be adjusted up and down thereby providing the wearer the ability to adjust the location to obtain a desired fit and comfort. In the preferred embodiment shown in FIG. 5, the adjustment could be made by providing a plurality of fastener parts 60 and 62 spaced along the length of the hanger 50. In this way, a wearer can adjust the length of the hanger 50 by selecting a particular fastener part to use for forming the loop. Alternatively, the adjustment to the length of the hangers could be made by using slides, loops or reducers of the type know in the art (not shown). It is contemplated that the length of the hangers 50 may be set to about 4 to 12 inches although other lengths could be selected. By adjusting the length of the hangers 60, the user can position the tool carrier 22 at a location that provides the most comfort and utility.

With reference to FIGS. 1-3, 5, and 7-8, the tool carrier 22 may be further secured to a leg strap 66 which secures the tool retaining apparatus 10 the wearer's leg 69. The leg strap 66 may be formed of nylon, leather, synthetic leather or other type of material known in the art for making straps and strap-like devices. Accordingly, the tool retaining apparatus 10 is supported both by the wearer's waist through securement to the wearer's belt 52 and by the wearer's leg 69 by way of the leg strap 66. By supporting a portion of the weight of the tool retaining apparatus 10 on the wearer's leg, stress on the wearer's back, and in particular the lower back, are reduced. Therefore, the tool retaining apparatus 10 can be worn for extended periods of time without causing discomfort. The leg strap 66 is secured to the body along a bottom portion of the back side 16*b* of the body. The leg strap 66 runs along the length L of the body and extends outwardly beyond the body side edges 16*c*. A portion of the leg strap extends from each side edge. The leg strap 66 is disposed generally towards the bottom of the body adjacent to a bottom edge 34.

The leg strap 66 end may include a fastening device 68 at the ends which allow the strap to be secured around the upper portion of the leg of a wearer, as shown in FIG. 1. The fastening device 68 may include complementary side or center release buckle components 68*a*, 68*b* of a type known in the art as shown in FIGS. 2 and 3. The leg strap 66 may also include an adjustment device 70 of a type known in the art in order to allow the leg strap to be loosened or tightened around one's leg. The adjustment device 70 may be part of the fastening device 68. The adjustment device 70 may be a strap buckle clip that allows the length of the strap to be adjusted. A tri-glide (not shown) of a type know in the art may also be used to aid in the adjustment of the strap length.

In addition, the leg strap 66 may include one or more auxiliary tool holders 74 (FIGS. 2, 7 and 8) in the form of loop sewn into the leg strap 66. These allows for tools, such as a hammer, to be secured to the tool retaining apparatus 10. In addition, or alternatively, auxiliary tool holders may be formed by stitching a plurality of undulating loops to the leg strap so that additional tools may be secured.

When the tool retaining apparatus 10 is secured to a wearer 14 as shown in FIG. 1, the belt hangers 50 are secured to a waist belt 52 worn by the wearer. The second end of the belt hangers are secured to the tool carrier 22. Accordingly, the tool carrier 22 is spaced a distance D from the waist belt 52. When the tool retaining apparatus 10 is secured to a wearer, the tool carrier 22 is located on the outer portion of the thigh 69 below and away from the hip/waist area. This position gives the wearer significant increased freedom of movement. In addition, by locating the tool carrier 22 below the waist, it is located at a natural position where one's hand would fall making for easy access to tools 14 held within the tool carrier 22. By securing the tool pouch to the leg, a portion of the weight of the tools is carried by the leg, thereby relieving stress on the hips and lower back. Furthermore, the location of the tool carrier 22 below the waist allows a safety harness 80 (FIG. 1A) to be worn and removed without having to remove the tool retaining apparatus 10.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. A tool retaining apparatus comprising:

a body having a front surface including thereon a plurality of retainers for securing a plurality of tools thereto, the body having a top edge and a bottom edge, the top edge having two opposed ends and each end being bounded by a side wall, the side walls and the top edge having a diagonal edge portion extending therebetween forming tapered corners, the body including a resilient inner pad encased by an outer cover;

a first and second hanger each having a first and second end, the hanger first ends each including an attachment member securable to a wearer, the hanger second ends each being secured to the body, the first hanger being spaced from the second hanger along a longitudinal extent of the body;

the body including a first and a second fold line extending transverse to the longitudinal extent of the body and between the top edge and the bottom edge of the body, the first and second fold lines including localized thin portions of the body, the fold lines dividing the body into a first, a second, and a third body segment, the first hanger having a portion of its length being aligned with the first fold line and the second hanger having a portion of its length being aligned with the second fold line;

wherein the first body segment includes a first exterior pocket having a closed bottom extending outwardly from the front surface of the body, the first pocket being disposed within a peripheral boundary of the first segment wherein the pocket does not extend beyond one of the first or second fold lines, and the third body segment is disposed between and directly adjoins the first body segment and the second body segment, and the first hanger is secured to the first body segment and the second hanger is secured to the second body segment; and a leg strap secured to the body, the leg strap including a fastening device to allow the leg strap to be opened and closed and secured around the thigh of a wearer.

2. The apparatus as defined in claim 1, wherein the first ends of the first and second hangers each include a loop formed therein, the loop adapted to receive a wearer's waist belt, wherein the length of the first and second hangers is adjustable.

3. The apparatus as defined in claim 1, wherein the second ends of the first and second hangers are fixedly secured to the body.

4. The apparatus as defined in claim 3, wherein the leg strap has a longitudinal extent extending beyond the longitudinal extent of body, the leg strap having ends to which complementary portions of the fastening device are attached.

5. The apparatus as defined in claim 1, wherein the length of the first and second hangers is substantially the same.

6. The apparatus as defined in claim 5, wherein the first and second hangers have a length of generally 7 to 12 inches.

7. The apparatus as defined in claim 1, wherein the leg strap includes thereon an auxiliary tool holder for removably securing one or more tools to the leg strap.

8. The apparatus as defined in claim 1, wherein the belt hangers and leg straps are secured to a back surface of the body.

9. The apparatus as defined in claim 1, wherein the first and second hanger straps have a length which is adjustable.

10. The apparatus as defined in claim 9, wherein the belt hanger attachment members each include a loop for receiving a wearer's belt, the loops being adjustable in size.

11. The apparatus as defined in claim 1, wherein the belt hangers are secured adjacent to the body top edge, and the waist belt is secured adjacent to the body bottom edge.

12. The tool retaining apparatus as defined in claim 1, wherein the second body segment includes a second exterior pocket having a closed bottom extending outwardly from the front surface of the body, the second pocket being disposed within a peripheral boundary of the second body segment wherein the pocket does not extend over either the first or second fold lines.

13. The tool retaining apparatus as defined in claim 12, wherein the third body segment includes a tool retaining device extending from the front surface of the body, the tool retaining device being disposed within a peripheral boundary of the third body segment wherein the tool retaining device does not extend over one of the first or second fold lines.

* * * * *